US008659492B2

(12) United States Patent
Lee

(10) Patent No.: US 8,659,492 B2
(45) Date of Patent: Feb. 25, 2014

(54) MULTIBAND ANTENNA

(75) Inventor: Yi-Chieh Lee, Tu-Cheng (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 459 days.

(21) Appl. No.: 13/052,208

(22) Filed: Mar. 21, 2011

(65) Prior Publication Data

US 2012/0162038 A1 Jun. 28, 2012

(30) Foreign Application Priority Data

Dec. 28, 2010 (TW) ..... 99146342 A

(51) Int. Cl.
*H01Q 9/00* (2006.01)

(52) U.S. Cl.
USPC ..... 343/749

(58) Field of Classification Search
USPC ..... 343/700
See application file for complete search history.

(56) References Cited

U.S. PATENT DOCUMENTS

| | | | | |
|---|---|---|---|---|
| 7,940,219 | B2 * | 5/2011 | Soekawa et al. | 343/702 |
| 8,472,908 | B2 * | 6/2013 | Anguera et al. | 455/272 |
| 2003/0098812 | A1 * | 5/2003 | Ying et al. | 343/702 |
| 2011/0215980 | A1 * | 9/2011 | Lai | 343/770 |
| 2012/0032862 | A1 * | 2/2012 | Ying | 343/749 |

* cited by examiner

*Primary Examiner* — Daniel Hess
*Assistant Examiner* — Steven J Malone
(74) *Attorney, Agent, or Firm* — Altis Law Group, Inc.

(57) ABSTRACT

A multiband antenna includes a feed unit, a transceiving unit, and a resonance unit positioned adjacent to but separate from the feed unit and the transceiving unit. When feed signals are input to the feed unit, the feed signals are transmitted to the transceiving unit to form current paths of different lengths, and the resonance unit is driven to resonate and generates additional current paths of different lengths. In this way, the transceiving unit and the resonance unit are enabled to respectively receive and send wireless signals of different frequencies, and thus the multiband antenna is capable of receiving and sending wireless signals in more than two frequency bands.

11 Claims, 3 Drawing Sheets

MULTIBAND ANTENNA

BACKGROUND

1. Technical Field

The present disclosure relates to multiband communication technology, and particularly to a multiband antenna for portable electronic devices.

2. Description of Related Art

Portable electronic devices, such as mobile phones, personal digital assistants (PDA), and laptop computers, often utilize mounted antennas for receiving/sending wireless signals. Many portable electronic devices may receive/send wireless signals of different frequencies, thus, requiring the presence of a multiband antenna.

However, multiband antennas tend to be large with a complicated structure, compromising efforts toward the minimization of portable electronic devices. Even where installation of miniaturized multiband antennas within such portable electronic devices is possible, communication capabilities of miniaturized multiband antennas may be adversely affected due to their limited size. For example, many multiband antennas used in portable electronic devices are unable to receive/send wireless signals in more than two frequency bands.

Therefore, there is room for improvement within the art.

BRIEF DESCRIPTION OF THE DRAWINGS

Many aspects of the present multiband antenna can be better understood with reference to the following drawings. The components in the various drawings are not necessarily drawn to scale, the emphasis instead being placed upon clearly illustrating the principles of the present multiband antenna. Moreover, in the drawings, like reference numerals designate corresponding parts throughout the figures.

DETAILED DESCRIPTION

Figure 1:
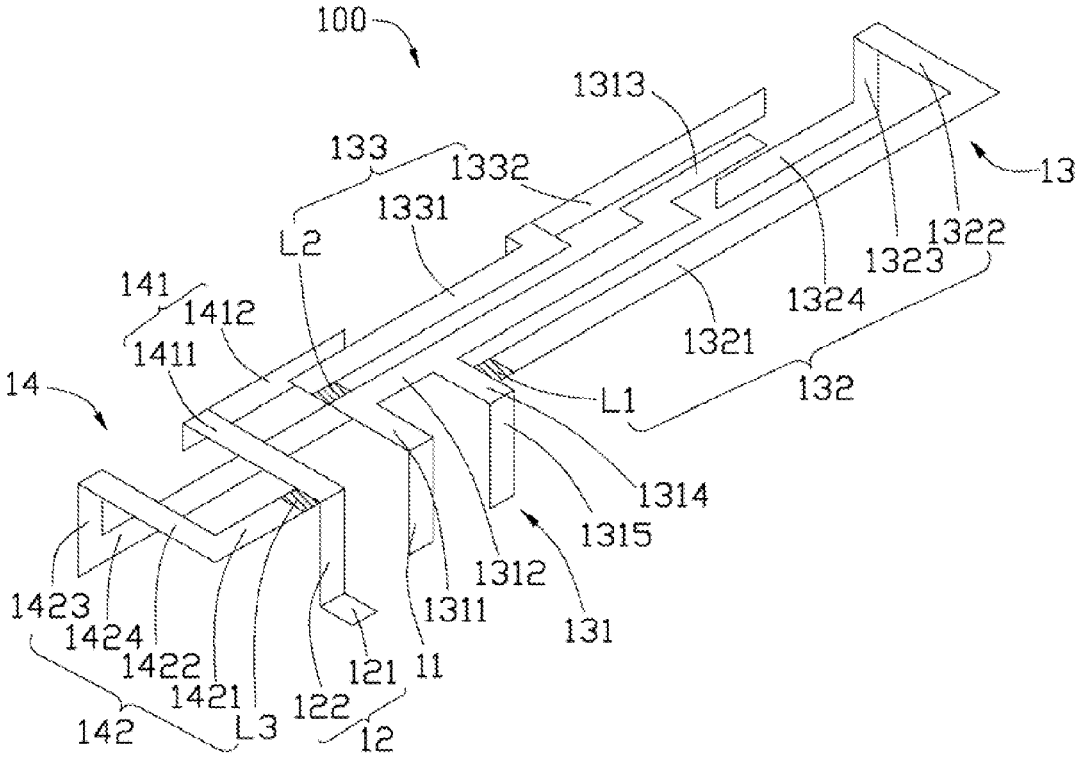
FIG. 1 is a schematic view of a multiband antenna, according to an exemplary embodiment.
Figure 2:
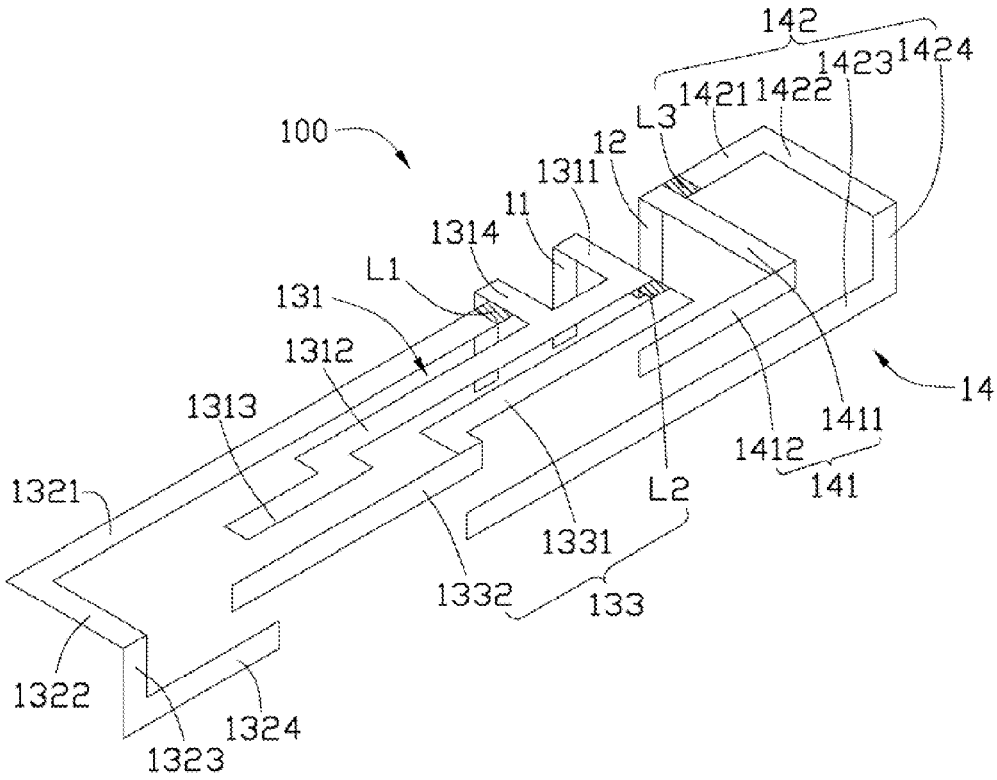
FIG. 2 is a schematic view of the multiband antenna shown in FIG. 1, viewed from another angle.

FIG. 1 and FIG. 2 schematically show a multiband antenna 100, according to an exemplary embodiment. The multiband antenna 100 consists of conductive sheets, such that size and profile thereof are minimized, meeting suitability for use in a portable electronic device such as a mobile phone, a personal digital assistant (PDA), or a laptop computer. The conductive sheets can be metal sheets, flexible printed circuits (FPC), or other material. In this embodiment, the multiband antenna 100 includes a feed unit 11, a ground unit 12, a transceiving unit 13, and a resonance unit 14.

The feed unit 11 and the ground unit 12 are positioned adjacent to but separated from each other. The feed unit 11 is a longitudinal planar sheet. The ground unit 12 includes a grounded portion 121 and a connecting portion 122, which are both longitudinal planar sheets. The connecting portion 122 is positioned coplanar with and parallel to the feed unit 11. The grounded portion 121 is positioned in a plane that is perpendicular to the plane in which the feed unit 11 and the connecting portion 122 are positioned, and is connected to one end of the connecting portion 122.

The transceiving unit 13 includes a first transceiving portion 131, a second transceiving portion 132, and a third transceiving portion 133. The first transceiving portion 131 includes a first transceiving section 1311, a second transceiving section 1312, a third transceiving section 1313, a fourth transceiving section 1314, and an extending section 1315, which are all longitudinal planar sheets. The first transceiving section 1311, the second transceiving section 1312, the third transceiving section 1313, and the fourth transceiving section 1314 are all positioned in a plane that is perpendicular to the plane in which the feed unit 11 and the connecting portion 122 are positioned. In addition, the extending section 1315 is positioned coplanar with the feed unit 11 and the connecting portion 122. Particularly, one end of the first transceiving section 1311 is connected to an end of the feed unit 11. The other end of the first transceiving section 1311 is perpendicularly connected to one side of one end of the second transceiving section 1312. A side of the other end of the second transceiving section 1312 is connected to an end of a side of the third transceiving section 1313, such that the third transceiving section 1313 is positioned to be substantially parallel to the second transceiving section 1312. In addition, the third transceiving section 1313 and the first transceiving section 1311 are respectively positioned at two opposite sides of the second transceiving section 1312. The fourth transceiving section 1314 is positioned at the same side of the second transceiving section 1312 as the first transceiving section 1311.

One end of the fourth transceiving section 1314 is perpendicularly connected to a middle part of the second transceiving section 1312, and the fourth transceiving section 1314 is parallel to the first transceiving section 1311. Another end of the fourth transceiving section 1314 is connected to the extending section 1315. The extending section 1315 is parallel to the feed unit 11.

The second transceiving portion 132 is connected to the fourth transceiving section 1314, and the first transceiving section 1311 and the second transceiving portion 132 are respectively positioned at two opposite sides of the fourth transceiving section 1314. The second transceiving portion 132 includes a first inductor L1, a sixth transceiving section 1321, a seventh transceiving section 1322, an eighth transceiving section 1323, and a ninth transceiving section 1324, which are all planar sheets. The first inductor L1, the sixth transceiving section 1321, and the seventh transceiving section 1322 are positioned coplanar with the first transceiving section 1311, the second transceiving section 1312, the third transceiving section 1313, and the fourth transceiving section 1314. The eighth transceiving section 1323 and the ninth transceiving section 1324 are positioned in a plane that is parallel to the plane in which the feed unit 11, the connecting portion 122, and the extending section 1315 are positioned. Particularly, the first inductor L1 is connected to a middle part of a side of the fourth transceiving section 1314. The sixth transceiving section 1321, the seventh transceiving section 1322, the eighth transceiving section 1323, and the ninth transceiving section 1324 are all longitudinal. One end of the sixth transceiving section 1321 is connected to the first inductor L1, and the sixth transceiving section 1321 extends parallel to the second transceiving section 1312 and the third transceiving section 1313. The other end of the sixth transceiving section 1321 is perpendicularly connected to one end of the seventh transceiving section 1322. The other end of the seventh transceiving section 1322 is connected to one end of the eighth transceiving section 1323. The other end of the eighth transceiving section 1323 is perpendicularly connected to the ninth transceiving section 1324.

The third transceiving portion 133 is connected to the second transceiving section 1312, and the second transceiving portion 132 and the third transceiving portion 133 are respectively positioned at two opposite sides of the second transceiving section 1312. The third transceiving portion 133 includes a second inductor L2, a tenth transceiving section 1331, and an eleventh transceiving section 1332, which are all planar sheets. The second inductor L2 and the tenth transceiving section 1331 are positioned coplanar with the first transceiving section 1311, the second transceiving section 1312, the third transceiving section 1313, and the fourth transceiving section 1314. The eleventh transceiving section 1332 is positioned coplanar with the eighth transceiving section 1323 and the ninth transceiving section 1324. Particularly, the second inductor L2 is connected to the other side of the end of the second transceiving section 1312 that is connected to the first transceiving section 1311. The tenth transceiving section 1331 and the eleventh transceiving section 1332 are both longitudinal. A side of one end of the tenth transceiving section 1331 is connected to the second inductor L2, and the tenth transceiving section 1331 extends parallel to the second transceiving section 1312. The eleventh transceiving section 1332 and the second inductor L2 are respectively positioned at two opposite sides of the tenth transceiving section 1331. A side of the other end of the tenth transceiving section 1331 is connected to a side of an end of the eleventh transceiving section 1332, and the eleventh transceiving section 1332 extends towards the eighth transceiving section 1323 and is substantially parallel to the ninth transceiving section 1324.

The resonance unit 14 is connected to the ground unit 12, and is positioned adjacent to but separated from the feed unit 11 and the transceiving unit 13. The resonance unit 14 includes a first resonance portion 141 and a second resonance portion 142.

The first resonance portion 141 includes a first resonance section 1411 and a second resonance section 1412, which are both longitudinal planar sheets. The first resonance section 1411 is positioned coplanar with the first transceiving section 1311, the second transceiving section 1312, the third transceiving section 1313, and the fourth transceiving section 1314. One end of the first resonance section 1411 is connected to the other end of the connecting portion 122, and the first resonance section 1411 extends parallel to the first transceiving section 1311 and the fourth transceiving section 1314. The second resonance section 1412 is positioned coplanar with the ninth transceiving section 1324 and the eleventh transceiving section 1332. A side of an end of the second resonance section 1412 is connected to the other end of the first resonance section 1411, and the second resonance section 1412 is positioned to be substantially collinear with the eleventh transceiving section 1332 and extends towards the eleventh transceiving section 1332.

The second resonance portion 142 includes a third inductor L3, a third resonance section 1421, a fourth resonance section 1422, a fifth resonance section 1423, and a sixth resonance section 1424, which are all planar sheets. The third resonance section 1421, the fourth resonance section 1422, the fifth resonance section 1423, and the sixth resonance section 1424 are all longitudinal. The third inductor L3, the third resonance section 1421, and the fourth resonance section 1422 are positioned coplanar with the first resonance section 1411, and the fifth resonance section 1423 and the sixth resonance section 1424 are positioned coplanar with the second resonance section 1412. Particularly, the third inductor L3 is connected to a side of the end of the first resonance section 1411 connected to the connecting portion 122, and the third inductor L3 and the first transceiving section 1311 are respectively positioned at two opposite sides of the first resonance section 1411. One end of the third resonance section 1421 is connected to the third inductor L3, and the third resonance section 1421 is positioned perpendicular to the first resonance section 1411. One end of the fourth resonance section 1422 is perpendicularly connected to the other end of the third resonance section 1421, and the fourth resonance section 1422 is positioned to be parallel to the first resonance section 1411. One end of the fifth resonance section 1423 is connected to the other end of the fourth resonance section 1422, and the fifth resonance section 1423 is parallel to the eighth transceiving section 1323. An end of the sixth resonance section 1424 is perpendicularly connected to the other end of the fifth resonance section 1423. The sixth resonance section 1424 is parallel to the second resonance section 1412.

When the multiband antenna 100 is used, the ground unit 12 can be attached to a circuit board (not shown) of the portable electronic device to be grounded, and the feed unit 11 is connected to the circuit board to receive feed signals. Feed signals input from the feed unit 11 can be directly transmitted to the first transceiving portion 131, and can be further transmitted to the second transceiving portion 132 and the third transceiving portion 133 via the first inductor L1 and the second inductor L2, respectively. Thus, current is generated in the transceiving unit 13 and a plurality of current paths of different lengths are respectively formed in the first transceiving portion 131, the second transceiving portion 132, and the third transceiving portion 133. Such that the first transceiving portion 131, the second transceiving portion 132, and the third transceiving portion 133 are respectively enabled to serve as antenna members for receiving and sending wireless signals at different frequencies. Additionally, the distal end of the extending section 1315 can be unconnected or grounded. If the distal end of the extending section 1315 can be unconnected, the extending section 1315 can be used as an additional part of the first transceiving portion 131 for receiving and sending wireless signals. If the distal end of the extending section 1315 is grounded, the first transceiving portion 131 is grounded through the extending section 1315, such that the first transceiving portion 131 can serve as an inverted-F antenna.

When current is generated in the transceiving unit 13, the resonance unit 14 is driven to resonate due to the current, and thereby is also enabled to serve as an antenna member. In this embodiment, when the grounded unit 12 grounds the resonance unit 14 so the resonance unit 14 resonates, the resonance unit 14 can serve as a coupled ground resonator to generate additional current paths of different lengths. The additional current paths include at least a current path generated in the first resonance portion 141 and another current path generated in the second resonance portion 142. Accordingly, the multiband antenna 100 can be used to receive and send wireless signals in a plurality of different frequency bands.

Figure 3:
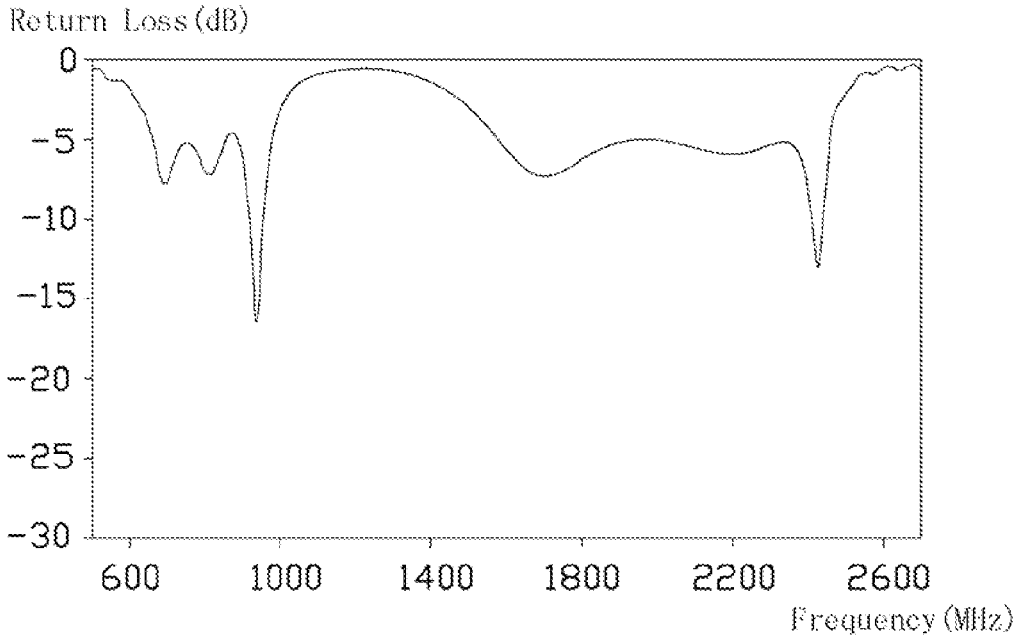
FIG. 3 is a diagram showing a return loss (RL) measurement of the multiband antenna shown in FIG. 1.

Referring to FIG. 3, as shown in experiments, the return loss (RL) of the multiband antenna 100 is acceptable when the multiband antenna 100 receives/sends wireless signals in multiple frequency bands. Particularly, the RL of the multiband antenna 100 is less than −5 dB when the multiband antenna 100 receive/send wireless signals at frequencies of about 700 MHz, 800 MHz, 930 MHz, 1700 MHz, and 2400 MHz. Accordingly, the electronic device employing the multiband antenna 100 can be used in a plurality of (more than two) common wireless communication systems, such as CDMA800, GSM900, DCS1800, or Bluetooth, with acceptable communication quality.

Due to the composition disclosed, in assembly, the multiband antenna 100 can be supported and be protected on a cubic substrate (not shown). The first transceiving section 1311, the second transceiving section 1312, the third transceiving section 1313, the fourth transceiving section 1314, the first inductor L1, the sixth transceiving section 1321, the seventh transceiving section 1322, the second inductor L2, the tenth transceiving section 1331, the first resonance section 1411, the third inductor L3, the third resonance section 1421, and the fourth resonance section 1422 can be attached on a top surface of the substrate. The feed unit 11, the connecting portion 122, and the extending section 1315 can be attached on a side surface of the substrate. The eighth transceiving section 1323, the ninth transceiving section 1324, the eleventh transceiving section 1332, the second resonance section 1412, the fifth resonance section 1423, and the sixth resonance section 1424 can be attached on another side surface of the substrate that is opposite to the side surface for mounting the feed unit 11, the connecting portion 122, and the extending section 1315. Thus, most parts of the multiband antenna 100 can be flatly attached on the substrate, with an assembly including the substrate and the multiband antenna 100 mounted thereon also defining a substantially cubic outer shape. Accordingly, the multiband antenna 100 is protected from damage, and assembly, installation, and transportation of the multiband antenna 100 are simplified.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A multiband antenna, comprising:

a feed unit;

a transceiving unit, the transceiving unit including a first transceiving portion, a second transceiving portion, and a third transceiving portion; the first transceiving portion connected to the feed unit, the second transceiving portion and the third transceiving portion connected to the first transceiving portion; and a resonance unit positioned adjacent to but separate from the feed unit and the transceiving unit, the resonance unit including a first resonance portion and a second resonance portion connected to the first resonance portion;

wherein when feed signals are input to the feed unit, the feed signals are respectively transmitted to the first transceiving portion, the second transceiving portion, and the third transceiving portion to form current paths of different lengths, and the resonance unit is driven to resonate and respectively generates additional current paths of different lengths in the first resonance portion and the second resonance portion, such that the first transceiving portion the second transceiving portion, the third transceiving portion, the first resonance portion, and the second resonance portion are enabled to respectively receive and send wireless signals of different frequencies, and thus the multiband antenna is capable of receiving and sending wireless signals in more than two frequency bands; and wherein the first transceiving portion includes a first transceiving section, a second transceiving section, a third transceiving section, and a fourth transceiving section, which are all longitudinal planar sheets and positioned coplanar with each other; one end of the first transceiving section connected to the feed unit, the other end of the first transceiving section connected to one side of one end of the second transceiving section, a side of the other end of the second transceiving section connected to the third transceiving section, such that the third transceiving section and the first transceiving section are respectively positioned at two opposite sides of the second transceiving section; the fourth transceiving section positioned at the same side of the second transceiving section as the first transceiving section, one end of the fourth transceiving section connected to the second transceiving section, the feed unit is a planar sheet positioned in a plane that is perpendicular to the plane in which the first transceiving section, the second transceiving section, the third transceiving section, and the fourth transceiving section are positioned, the first transceiving portion further includes an extending portion, the extending portion being a longitudinal planar sheet positioned coplanar with the feed unit and connected to the other end of the fourth transceiving section, the second transceiving portion is connected to the fourth transceiving section, and the first transceiving section and the second transceiving portion are respectively positioned at two opposite sides of the fourth transceiving section; and wherein the second transceiving portion includes a first inductor, a sixth transceiving section, a seventh transceiving section, an eighth transceiving section, and a ninth transceiving section, which are all planar sheets; the first inductor, the sixth transceiving section, and the seventh transceiving section positioned coplanar with the first transceiving section, the second transceiving section, the third transceiving section, and the fourth transceiving section; and the eighth transceiving section and the ninth transceiving section positioned in a plane that is parallel to the plane in which the feed unit is positioned.

2. The multiband antenna as claimed in claim 1, wherein the extending portion is grounded; when the feed signals are transmitted to the first transceiving portion, the first transceiving portion is grounded through the extending section.

3. The multiband antenna as claimed in claim 1, wherein the distal end of the extending portion is unconnected; when the feed signals are transmitted to the first transceiving portion, the extending section serves as an additional part of the first transceiving portion for receiving and sending wireless signals.

4. The multiband antenna as claimed in claim 1, wherein the sixth transceiving section, the seventh transceiving section, the eighth transceiving section, and the ninth transceiving section are all longitudinal; the first inductor connected to the fourth transceiving section, one end of the sixth transceiving section connected to the first inductor, and the sixth transceiving section extending parallel to the second transceiving section and the third transceiving section; the other end of the sixth transceiving section perpendicularly connected to one end of the seventh transceiving section; the other end of the seventh transceiving section connected to one end of the eighth transceiving section; the other end of the eighth transceiving section perpendicularly connected to the ninth transceiving section.

5. The multiband antenna as claimed in claim 4, wherein the third transceiving portion is connected to the second transceiving section, and the second transceiving portion and the third transceiving portion are respectively positioned at two opposite sides of the second transceiving section.

6. The multiband antenna as claimed in claim 5, wherein the third transceiving portion includes a second inductor, a tenth transceiving section, and an eleventh transceiving section, which are all planar sheets; the second inductor and the tenth transceiving section positioned coplanar with the first transceiving section, the second transceiving section, the third transceiving section, and the fourth transceiving section; the eleventh transceiving section positioned coplanar with the eighth transceiving section and the ninth transceiving section.

7. The multiband antenna as claimed in claim 6, wherein the tenth transceiving section and the eleventh transceiving section are both longitudinal; the second inductor connected to the other side of the end of the second transceiving section connected to the first transceiving section, the tenth transceiving section connected to the second inductor and extending parallel to the second transceiving section; the eleventh transceiving section connected to the tenth transceiving section and extending towards the eighth transceiving section and substantially parallel to the ninth transceiving section, and the eleventh transceiving section and the second inductor respectively positioned at two opposite sides of the tenth transceiving section.

8. The multiband antenna as claimed in claim 7, wherein the first resonance portion includes a first resonance section and a second resonance section connected to the first resonance section, which are both longitudinal planar sheets; the first resonance section positioned coplanar with the first transceiving section, the second transceiving section, the third transceiving section, and the fourth transceiving section, and extending parallel to the first transceiving section and the fourth transceiving section; the second resonance section positioned coplanar with and substantially collinear with the eleventh transceiving section, and extending towards the eleventh transceiving section.

9. The multiband antenna as claimed in claim 8, wherein the second resonance portion includes a third inductor, a third resonance section, a fourth resonance section, a fifth resonance section, and a sixth resonance section, which are all planar sheets; the third inductor, the third resonance section, and the fourth resonance section positioned coplanar with the first resonance section, and the fifth resonance section and the sixth resonance section positioned coplanar with the second resonance section.

10. The multiband antenna as claimed in claim 9, wherein the third resonance section, the fourth resonance section, the fifth resonance section, and the sixth resonance section are all longitudinal; the third inductor connected to the first resonance section, one end of the third resonance section connected to the third inductor; one end of the fourth resonance section connected to the other end of the third resonance section, and the fourth resonance section positioned to be parallel to the first resonance section; one end of the fifth resonance section connected to the other end of the fourth resonance section; the sixth resonance section connected to the other end of the fifth resonance section, and the sixth resonance section positioned to be parallel to the second resonance section.

11. The multiband antenna as claimed in claim 1, further comprising a ground unit, the ground unit including a grounded portion and a connecting portion, which are both planar sheets; the connecting portion positioned coplanar with the feed unit and connected to the first resonance portion, and the grounded portion connected to the connecting portion.

* * * * *